US006976289B1

(12) United States Patent
Luca

(10) Patent No.: US 6,976,289 B1
(45) Date of Patent: Dec. 20, 2005

(54) DOOR CLOSER WITH DOOR ARRESTING MECHANISM

(76) Inventor: Valentin Luca, 1157 Melville Ave., Fairfield, CT (US) 06825

( * ) Notice: Subject to any disclaimer, the term of this patent is extended or adjusted under 35 U.S.C. 154(b) by 108 days.

(21) Appl. No.: 10/627,261

(22) Filed: Jul. 25, 2003

(51) Int. Cl.[7] ..... E05F 1/08
(52) U.S. Cl. ..... 16/76; 16/66; 16/49; 16/82
(58) Field of Search ..... 16/78, 66, 65, 16/72, 71, 67, 49, 82, 84, 85, DIG. 17; 49/386, 49/394; 292/165, 166, 265, 266, 269, 273, 292/277

(56) References Cited

U.S. PATENT DOCUMENTS

| | | | | | |
|---|---|---|---|---|---|
| 658,533 | A | * | 9/1900 | Schuyler | 16/84 |
| 1,898,609 | A | * | 2/1933 | Anderson | 16/61 |
| 2,455,488 | A | * | 12/1948 | Holman | 16/82 |
| 3,136,571 | A | * | 6/1964 | Johnson | 292/166 |
| 3,538,537 | A | * | 11/1970 | Strauss | 16/66 |
| 4,048,695 | A | * | 9/1977 | Juilfs et al. | 16/65 |
| 4,194,264 | A | * | 3/1980 | Stoffregen | 16/52 |
| 4,357,731 | A | * | 11/1982 | Strauss | 16/70 |
| 4,878,265 | A | * | 11/1989 | Nesbitt | 16/49 |
| 4,920,609 | A | * | 5/1990 | Lin | 16/66 |
| 5,157,806 | A | * | 10/1992 | Wartian | 16/66 |
| 5,630,248 | A | | 5/1997 | Luca | |
| 5,832,562 | A | | 11/1998 | Luca | |
| 5,842,255 | A | | 12/1998 | Luca | |
| 6,615,449 | B1 | * | 9/2003 | Alvarez | 16/66 |
| 6,634,058 | B1 | * | 10/2003 | Lin | 16/66 |

FOREIGN PATENT DOCUMENTS

| | | | | |
|---|---|---|---|---|
| EP | 409445 | A1 * | 1/1991 | E05F 3/10 |
| EP | 465795 | A1 * | 1/1992 | E05F 3/12 |

* cited by examiner

*Primary Examiner*—Chuck Y. Mah
(74) *Attorney, Agent, or Firm*—Fattibene & Fattibene; Paul A. Fattibene; Arthur T. Fattibene

(57) ABSTRACT

A door closer having a door arresting mechanism to arrest a door in an opened position that includes a cylinder and piston assembly wherein the arresting mechanism includes a cam member having an arresting dwell cam profile and an indexing profile, and an associated cam follower member wherein one member is connected to the piston rod and the other member to the cylinder so that one member is fixedly connected to either the cylinder or piston rod and the other member rendered rotatable relative to the fixed member so that the arresting mechanism is rendered self actuating upon the opening or closing of the door.

19 Claims, 14 Drawing Sheets

DOOR CLOSER WITH DOOR ARRESTING MECHANISM

RELATED MATTER

This application relates to a Disclosure Document No. 530925 directed to a Door Closer with Hold Open Mechanism filed on or about May 6, 2003.

FIELD OF THE INVENTION

This invention relates to a door closer, and more specifically to a door closer having a self-actuating door arresting mechanism.

BACKGROUND OF THE INVENTION

Heretofore, various types of door closers are known. Generally, such known door closers include a piston and cylinder assembly in which a piston is reciprocally disposed within a cylinder, and having a compression spring interposed between the piston and one end of the cylinder for normally biasing the piston toward a door closing position. A piston rod is connected to the piston wherein the free end of the piston rod is extended beyond the end wall of the cylinder. The free end of the piston rod and the end of the cylinder opposed to the piston rod are suitably connected between a door frame and the associated door so that upon the opening of the door, the piston is rectilinearly displaced within the cylinder, causing the spring to be compressed. The spring, in its compressed state, will normally function to return the door toward its closed position upon the release of the door after the opening thereof.

To prevent or to prohibit the closing of the door upon the release of the door, as is frequently desired, such door closers have been provided with an arresting device slidably disposed on the extended end of the piston rod that is manually positioned by the user to arrest the door from closing. Generally, the commonly known arresting device comprises merely a cantering washer which was slidably disposed on the extended end of the piston rod and required the user to manually position the cantering washer along the piston rod to arrest the door. The arrangement was such that the door, on being arrested, caused the cantering washer to frictionally bind or arrest the movement of the piston rod upon the cantering washer engaging the adjacent end of the cylinder. To disengage the arresting or cantering washer, the user would have to manually shift the cantering washer to a normal position relative to the axis of the piston rod to release the frictional forces arresting the piston rod.

Other, more recent, types of door latching or arresting mechanisms are disclosed in my prior patents, viz., U.S. Pat. Nos. 5,630,248; 5,832,562; 5,842,255. While the known types of arresting mechanisms are functional, efforts to devise door closers with new and improved arresting mechanisms is ongoing.

SUMMARY OF THE INVENTION

An object of this invention is to provide a door closure with an improved, automatic acting, arresting mechanism which is preferably disposed internally of the cylinder of the door closure.

Another object is to provide an improved door arresting mechanism having complimentary members in the form of a cam member and associated cam follower that may be operatively connected to the cylinder and the associated piston rod respectively or vice versa.

Another object is to provide for simple and positive acting arresting mechanism for use with a piston and cylinder type door closure that is self-actuating for arresting a door in a door opened position.

Another object is to provide an arresting mechanism which is automatically released from its door arresting position simply by shifting the door slightly toward the opening position and releasing the door.

The foregoing objects, features and other, advantages are readily attained in a door closer having a piston and cylinder assembly in which the piston is reciprocally displaceable within the cylinder and having a connected piston rod extending outwardly through one end of the cylinder. A compression spring is disposed between the piston and one end of the cylinder. With the piston and cylinder interconnected between a door frame and the associated door, the arrangement is such that upon the opening of the door, the compression spring normally biasing the piston toward the door closed position is compressed.

In accordance with this invention, an arresting mechanism is disposed between the cylinder and associated piston rod, which is rendered self-actuating to arrest the door in a door opened position. This is attained by a cam member and an associated complementary cam follower member which are operatively connected to the cylinder and the piston rod for relative rectilinear and rotational movement therebetween. The cam member is in the form of a bushing or sleeve having formed on either the external surface or internal surface, an indexing cam and a series of spaced apart arresting cam which defines therebetween an annular cam track or channel for receiving and guiding the cam following member therealong. The cam member and the follower member may be connected to either the piston rod or the cylinder so as to render one reciprocally movable relative to the other as the piston and piston rod are rendered displaceable between open and closed position. The arrangement is such that as the cam follower member engages the indexing cam of the cam member, the cam member is indexed so that upon release of the door, the cam follower member engages an arresting cam to prohibit the return of the piston to the door closing position. A slight shift of the door toward the open position from its arrested position causes the cam follower to engage the indexing cam to index the same, whereby the cam follower is positioned in alignment with a channel opening defined between adjacent arresting cams, thereby permitting the piston and connected piston rod, biased by the compression spring, to be fully advanced toward a closed door position.

It will be understood that the complementary cam member and the cam follower member can be readily interchanged in position so long as one is rendered rectilinearly movable relative to the other and one is rendered rotatable relative to the other, as more fully described herein.

IN THE DRAWINGS

DETAIL DESCRIPTION

Figure 1:
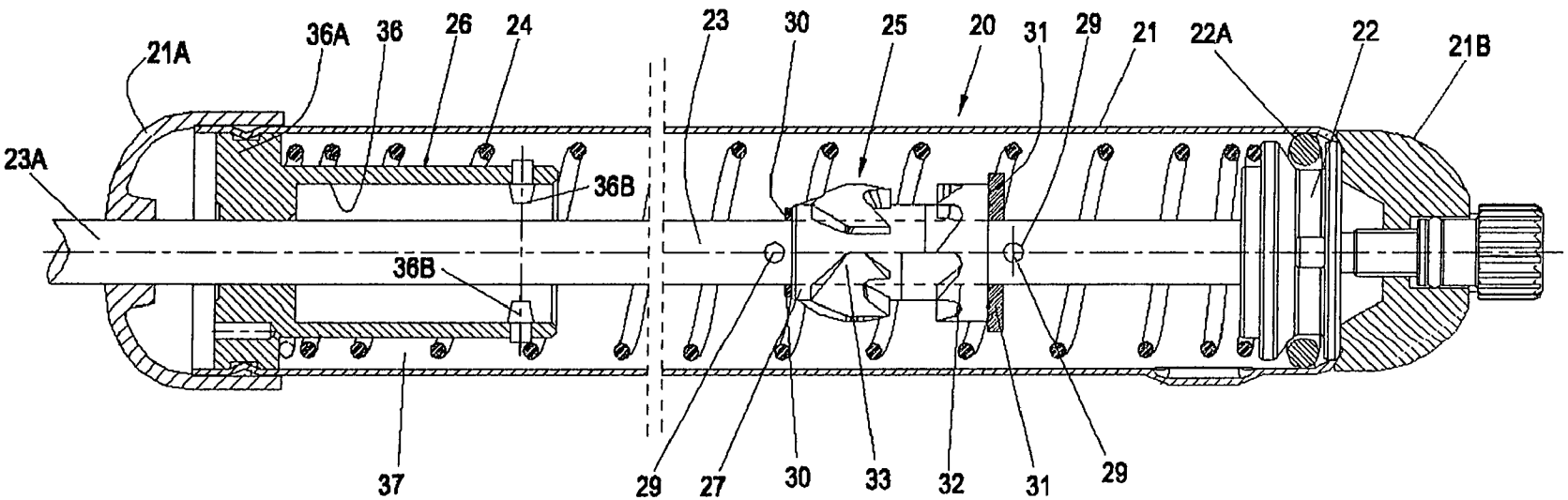
FIG. 1 is a sectional side view of a door closer illustrating the details of one embodiment of the invention.
Figure 1A:
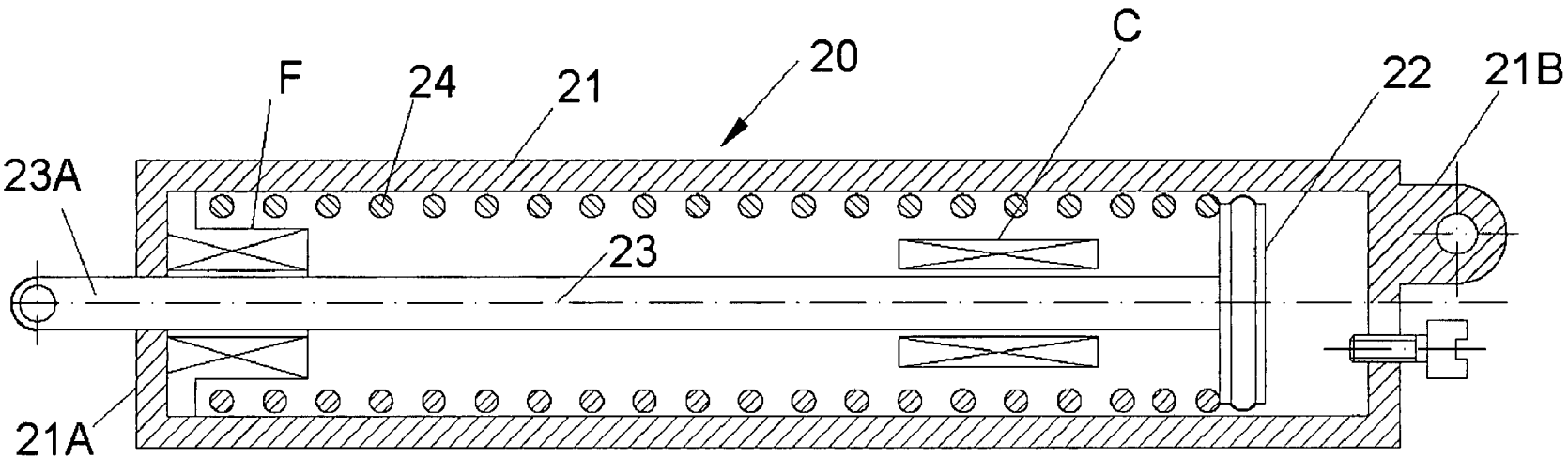
FIG. 1A is a schematic sectional view of a door closer embodying the invention.

Referring to the drawings, FIG. 1A is directed to a schematic showing of the invention. FIG. 1A illustrates a door closer 20 which includes a cylinder 21 having a piston 22 reciprocally displaceable therein. A piston rod 23 is connected to the piston 22, the free end 23A of the piston rod extending through and beyond the end wall 21A of the cylinder 21. A compression spring 24 is interposed between the piston 22 and end wall 21A. The arrangement is such that the compression spring 24 exerts a spring bias on the piston 22 to normally urge the piston toward a door closing position. With the free end 23A of the piston rod and the opposite end wall 21B of the cylinder 21 suitably connected between a door frame and an associated door (not shown), the arrangement is such that upon the opening of the door, the compression spring 24 is compressed. Upon release of the door, the compression spring will urge the piston 22 to its door closing position.

To arrest the door from closing upon the release thereof, an arresting mechanism is provided. The arresting mechanism, as schematically illustrated in FIG. 1A, includes two components, viz. a cam means C and a complementary cam follower means F, one of which may be connected to the cylinder and the other connected to the piston rod 23 or vice versa. Also, one of the components C or F is rotatably mounted relative to the cylinder or piston to which it is connected, while the other component is affixed to the cylinder or piston rod accordingly. For example, as schematically illustrated in FIG. 1A, the cam means or component C is illustrated as being associated with the piston rod 23 and the complementary cam follower means or component F is illustrated as being associated with the cylinder 21, whereby one of the components C or F is rendered rotatable relative to the other.

Figure 1B:
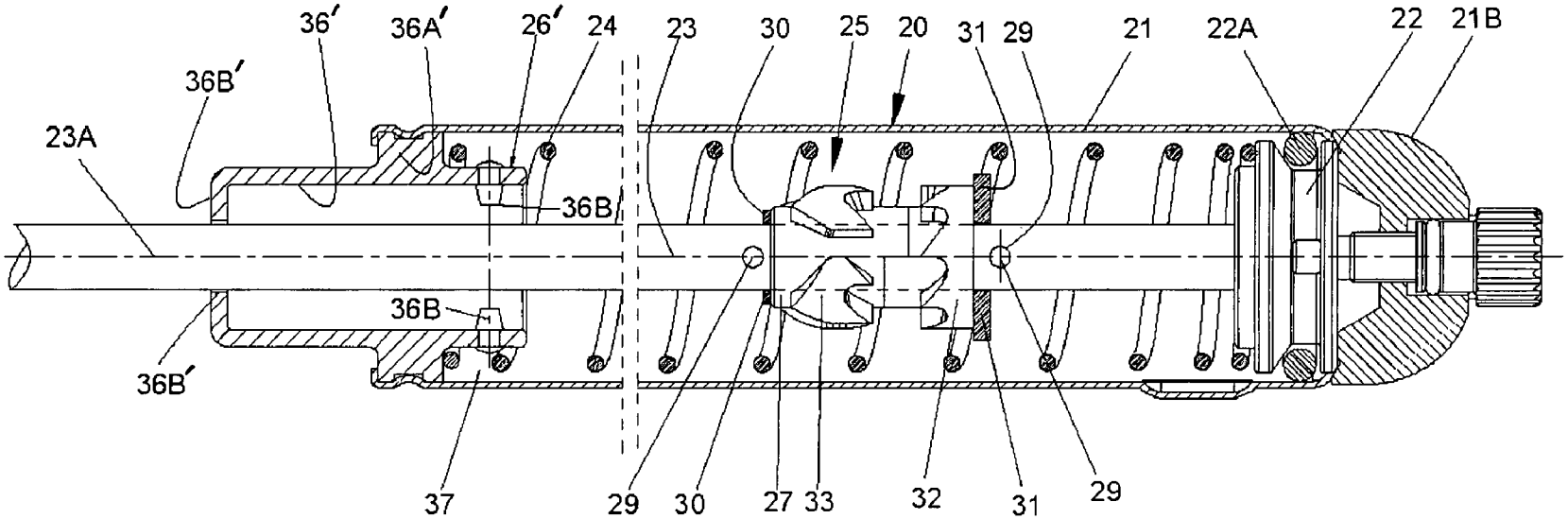
FIG. 1B is a sectional side view of a modified embodiment of a door closer of the type shown in FIG. 1.

FIG. 1 illustrates one embodiment of the invention in detail. FIG. 1B illustrates a slightly modified version. Referring to FIG. 1, the door closer 20 includes an elongated cylinder 21 having connected end walls 21A and 21B. Reciprocally disposed within the cylinder 21 is a piston 22. A suitable sealing ring or wiper 22A circumscribes the piston 22. Connected to the piston 22 is a piston rod 23 which has its free end 23A extended through an end wall 21A of the cylinder 21. A compression spring 24 is interposed about the piston rod 23 for exerting a spring bias on the piston 22 for normally urging the piston 22 toward its door closing position. With the piston and cylinder assembly described, the arrangement is such that when the assembly is suitably connected between a door frame and its associated door, the compression spring 24 is compressed upon the opening of the door. Upon release of the door, and in the absence of any arresting means, the compression spring will bias the piston 22 to the door closing position.

As it is desirous to provide such door closer 20 with a means for arresting the door in the open position upon the release of the door, the present invention includes an arresting means which is self-actuating to effect the arresting the door in the open position upon the release of the door. The arresting means is deactivated by imparting a slight movement of the door in the direction of opening from its arrested open position, whereby, upon release, the bias of the compression spring acting on the piston returns the door to its fully closed position.

In the embodiment illustrated in FIG. 1, the arresting means comprises a cam means 25 which is rotatably mounted on the piston rod 23 and a complementary cam follower means 26 which is fixedly connected to the cylinder 21.

Figure 3:
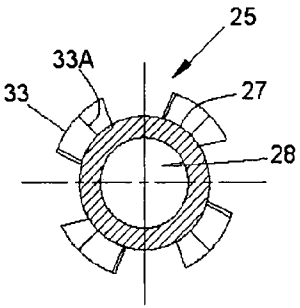
FIG. 3 is a section view taken along line 3—3 on FIG. 2.
Figure 2:
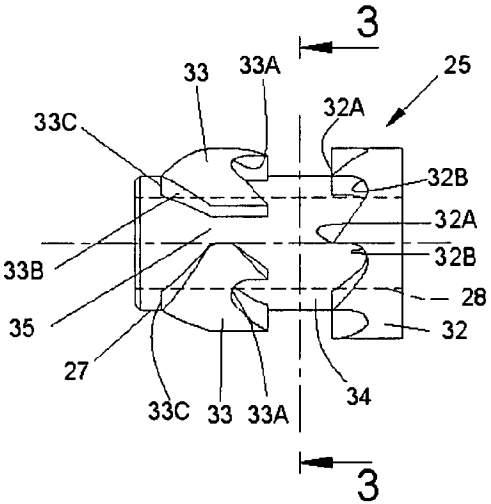
FIG. 2 is a detail side view of one embodiment of the cam portion of the arresting mechanism embodied in the door closer of FIG. 1.

Referring to FIGS. 2 and 3, the cam means 25 comprises a bushing or sleeve 27 having a through bore 28 through which the piston rod 23 extends, and whereby the cam bushing or sleeve 27 is rendered freely rotatable about the piston rod 23. The piston rod 23 is provided with suitable stops in the form of pins or protrusions 29, 29 disposed at both ends of the cam bushing or sleeve 27, as shown in FIG. 1, to prohibit relative linear displacement between the cam sleeve 27 and the piston rod 23. If desired, suitable washers 30 and 31 may be interposed between the stops 29, 29 and the corresponding adjacent end of the bushing or sleeve 27.

Formed on the outer surface or periphery of the cam sleeve 27, at the end nearest to the piston 22 there is formed an indexing cam 32 having a cam profile formed of a series of alternating peaks 32A and dwells 32B. Also formed in the outer surface of the cam bushing or sleeve 27 are a plurality of circumferentially spaced arresting cams 33, each having an arresting dwell 33A. The arresting cams 33 and the annular indexing cam 32 are spaced apart to define therebetween a circumscribing channel 34. The arrangement is such that, the alternating peaks 32A of the indexing cam 32 are substantially in alignment with the arresting dwells 33A of the arresting cams 33 with the intermediate peaks 32A in alignment with the channel opening 35, the space defined between adjacent pairs of arresting cams 33 for receiving a cam follower, as will be hereinafter described. The arresting cam profile 33B, opposite its dwell profile 33A, converges to a point or edge 33C for directing a cam follower toward the channel opening 35 as will be disclosed hereinafter.

The complementary cam follower means 26, as illustrated in FIG. 1, includes a tubular member 36 having an enlarged base 36A, which is connected to the cylinder internally thereof, to form an inner end wall of the cylinder chamber 37 defined between the piston 22 and the base 36A. As noted in FIG. 1, the end of the compression spring abuts against base 36A and circumscribes the tubular member 36. The internal diameter of the tubular member 36 is sized to receive the cam means 25 as will be herein described.

Projecting radially inwardly of the tubular member 36 are one or more cam followers 36B. Two such cam followers 36B are shown in FIG. 1. It will be noted that the cam follower is fixed relative to the cylinder 21. In the illustrated embodiment, each cam follower 36B is illustrated as a fixed pin.

With the construction of the door closer 20 as described, it will be apparent that as the associated door is opened, the piston rod 23 will retract, e.g. be pulled or shifted to the left as viewed in FIG. 1, causing the cam means 25 to be moved toward the cam follower means 26 fixed to one end of the cylinder.

Figure 6:
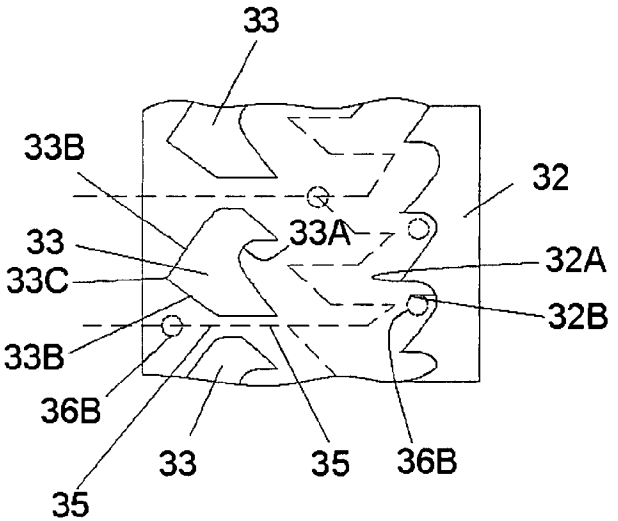
FIG. 6 is an expanded view cam profile of the arresting mechanism of FIG. 1 as utilized in the door closer.

Referring to FIG. 6, as the cam follower 36B engages profile 33B of the arresting cam 33, the cam bushing or sleeve 27 will be caused to rotate relative to the piston rod 23 and in doing so, will direct the cam follower 36B to a channel opening 35. As the door approaches a predetermined opened position, the cam follower 36B passing through the channel opening 35 is received within the dwell 32B of the indexing cam profile. Upon release of the door, the compression spring 24 will normally urge the door toward its closing position. However, the arrangement is such that upon release of the door upon opening of the door, the cam follower 36B, now in dwell 32B, causes the cam sleeve to index or rotate to redirect the cam follower 36B to the arresting dwell 33A of the arresting cam 33 to prohibit the closing of the door automatically.

To release the door from its arrested opened position, one need only to move the door slightly toward the door opening direction whereby the cam follower 36B will engage the next succeeding dwell 32B of indexing cam, causing the indexing cam 32 to rotate an amount sufficient to place the cam follower 36B in alignment with a channel opening 35. As the cam follower 36B is now in alignment with the channel opening 35, the force of the compression spring being no longer arrested by the cam follower 36B engaging the arresting dwell 33A, will cause the piston 22 to be advanced to its fully door closed position. The cycle is thus repeated upon each full opening of the door.

FIG. 1B illustrates a slightly modified version of the described embodiment of FIG. 1. The embodiment illustrated in FIG. 1B is similar to that disclosed in FIG. 1 wherein like reference numerals refer to like described components. The embodiment of FIG. 1B differs in that the cam followers means 26' includes a tubular member 36' which is provided with a radial outwardly extending flange 36A' disposed intermediate thereof, by which the cam follower means 26' is connected to one end of cylinder 21. Thus, the end of the cylinder terminates at the flange 36A' of the follower means 26'. The free end of the piston rod 23A extends out through an end opening 36B' of tubular member 36' end wall 36C'. In all other respects, the structure and operation of the embodiment of FIG. 1B is similar to that described with respect to FIG. 1.

Figure 2A:
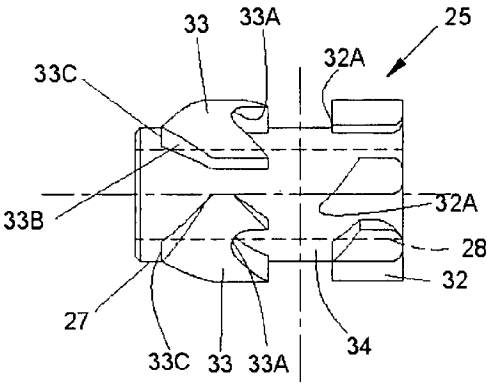
FIG. 2A is a detail side view of a modified embodiment of the cam portion of FIG. 2.

FIG. 2A illustrates a modified version of the indexing cam 25' as herein described. Whereas the indexing cam 32 of the cam component 25 herein described with respect to FIG. 2, is formed with an annular or continuous cam profile having a series of peaks 32A and dwells 32B, the indexing cam profile as depicted in the modified cam 25' of FIG. 2A comprise a series of spaced apart cam segments 25A or an interrupted cam profile to define a channel 25B between adjacent cam segments 25A. In all other respects, the construction of cam component 25 of FIG. 2A is similar to that of cam component 25 of FIG. 2. Therefore, instead of dwells 32B illustrated in FIG. 2, the cam component 25' of FIG. 2A is provided with a channel 25B for receiving and directing the cam follower 36B toward the arresting dwell 33A of the arresting cam 33 to prohibit the door from closing, or to channel 35 to permit the door to be urged toward its fully closed position as hereinbefore described.

The relative position of the arresting cam profile 33 and the indexing cam segments 25A of the cam component 25' of FIG. 2A, are similar to the arresting cam profiles 33 and indexing cam 32, so that the cam component 25' functions in a manner similar to that of cam component 25 of FIG. 2 as hereinbefore described.

Figure 8:
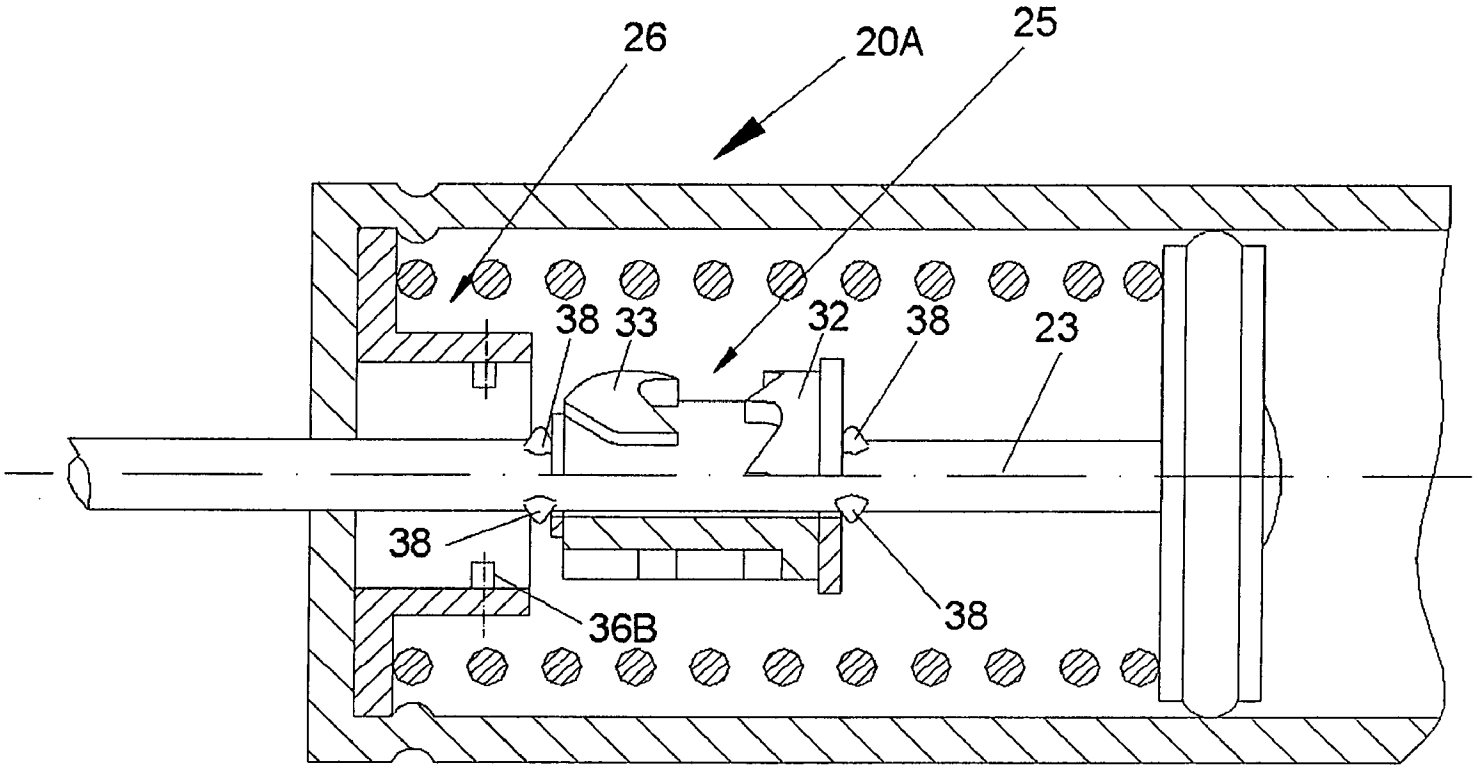
FIG. 8 is a fragmentary side view of a slightly modified form of the invention.

The embodiment of FIG. 8 is similar to that of FIG. 1 with the exception that the cam means 25 is retained on the piston rod 23 for movement therewith by means of a ridge, rim or protrusion 38 located on the piston rod 23 adjacent the opposed ends of the cam means 25. In all other respects, the structure, function and operation of the door closer 20A of FIG. 8 is similar to that described with respect to FIG. 1.

Figure 8A:
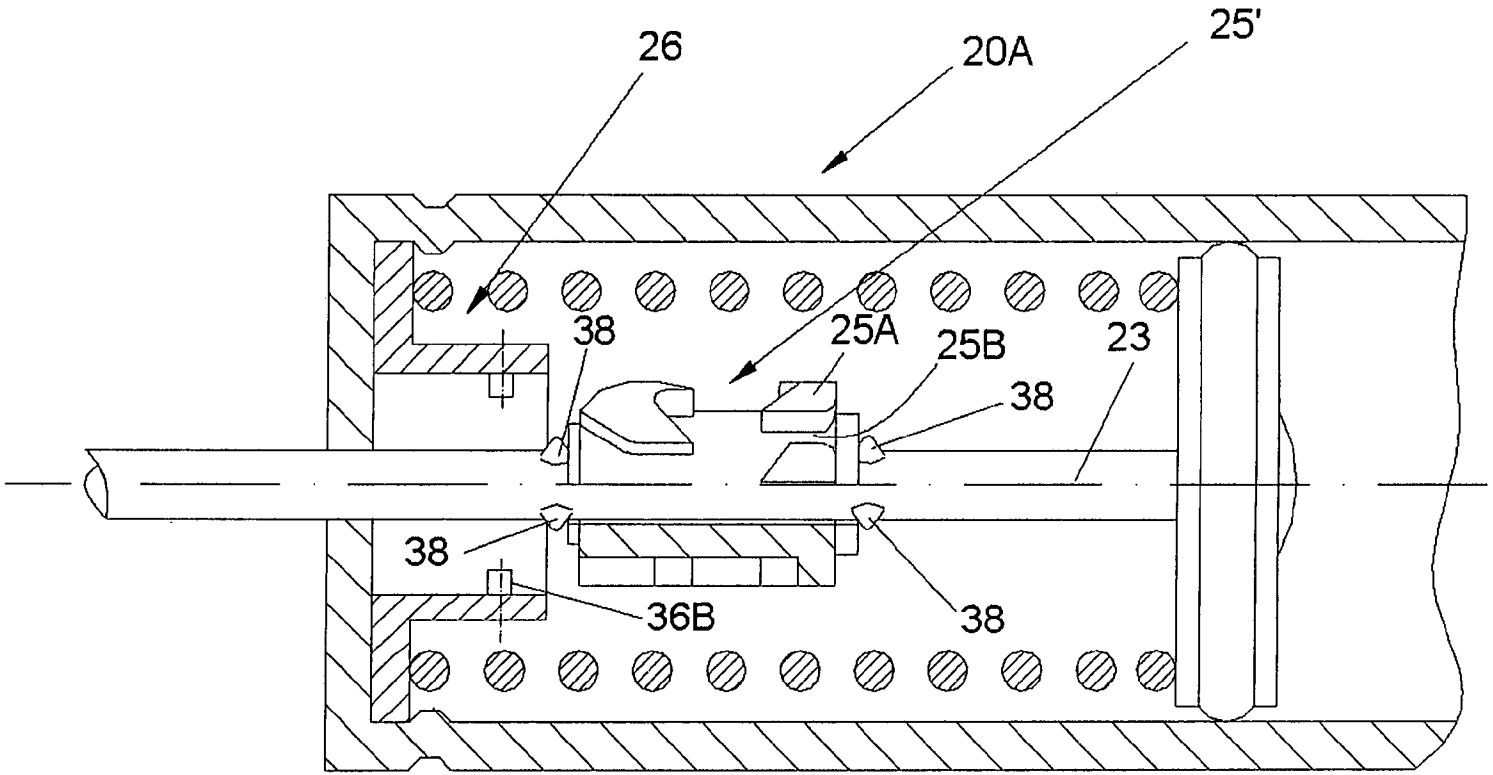
FIG. 8A is a fragmentary sectional side view of a modified embodiment of the type shown in FIG. 8.

FIG. 8A illustrates a slightly modified version of the embodiment disclosed in FIG. 8. In FIG. 8A, the cam component 25 is provided with an interrupted indexing cam as shown in FIG. 2A. In all other respects, the embodiment of FIG. 8A is similar in function and structure as hereinbefore described.

Figure 9:
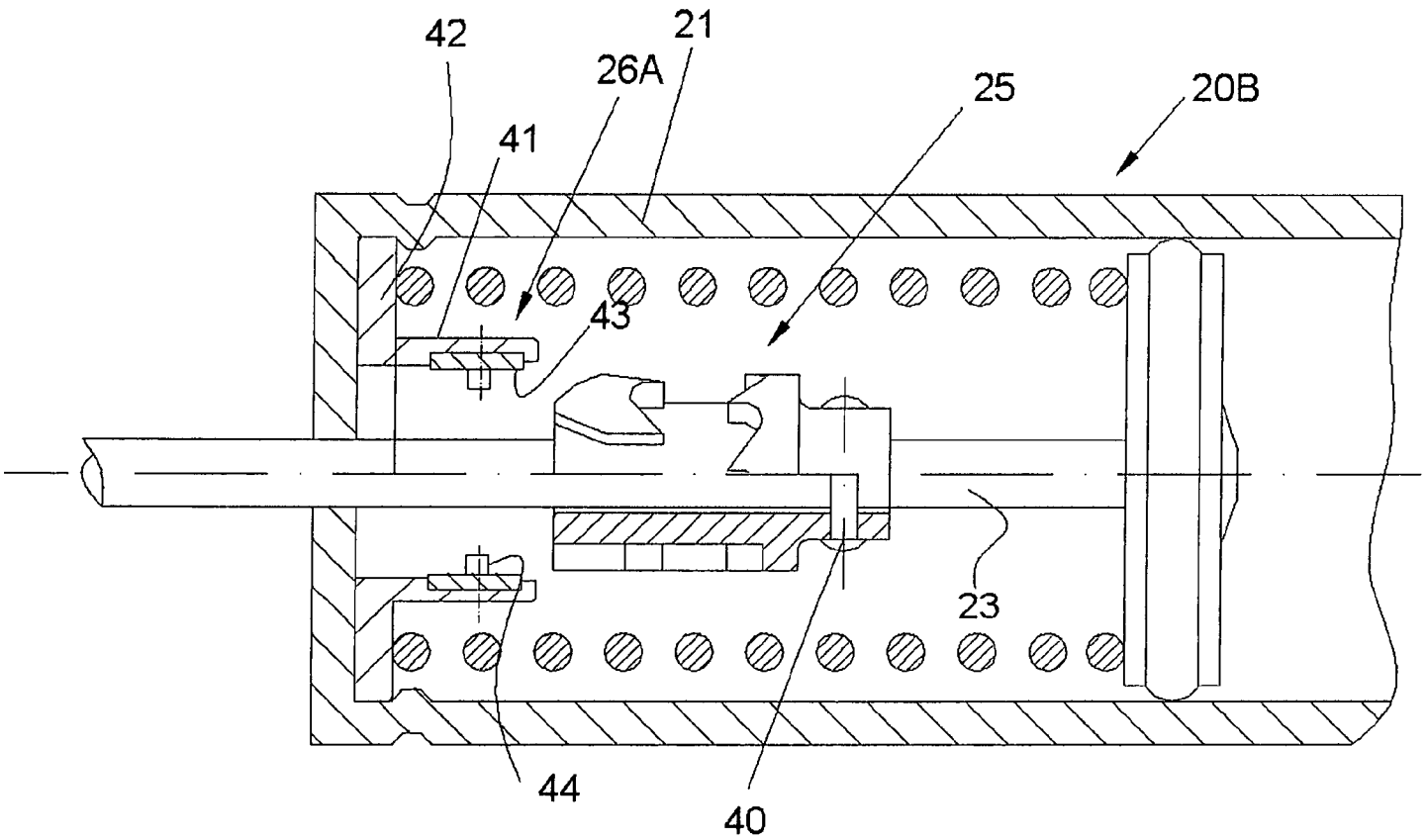
FIG. 9 is a fragmentary side view of another modified form of the invention.

FIG. 9 is directed to a modified form of the invention. In this form of the invention, the door closer 20B utilizes a cam means 25 in the form of a sleeve or bushing, as hereinbefore described, but is fixedly secured to the piston rod 23 by suitable means, e.g. a set pin, screw, or like 40; or by other means such as a weld, solder and the like. In this form of the invention, the complementary cam follower means 26A is rendered rotatable relative to the cam means 25. As shown in FIG. 9, the cam follower means 26A includes a tubular member 41 having a base 42 which is suitable connected to the cylinder 21. A cam follower ring 43 is rotatably journalled to the internal periphery of the tubular member 41. Projecting radially inwardly of the follower ring 43 are one or more cam followers 44. Two such cam followers 44 are illustrated. Thus, in this form of the invention, the cam means 25 is fixedly secured to the piston rod 23 whereas the cam followers 44 are rotatably journalled within the tubular member 41. In all other respects, the structure and operation of the embodiment of FIG. 9 is similar to that described with respect to FIG. 1, and need not be repeated.

Figure 9A:
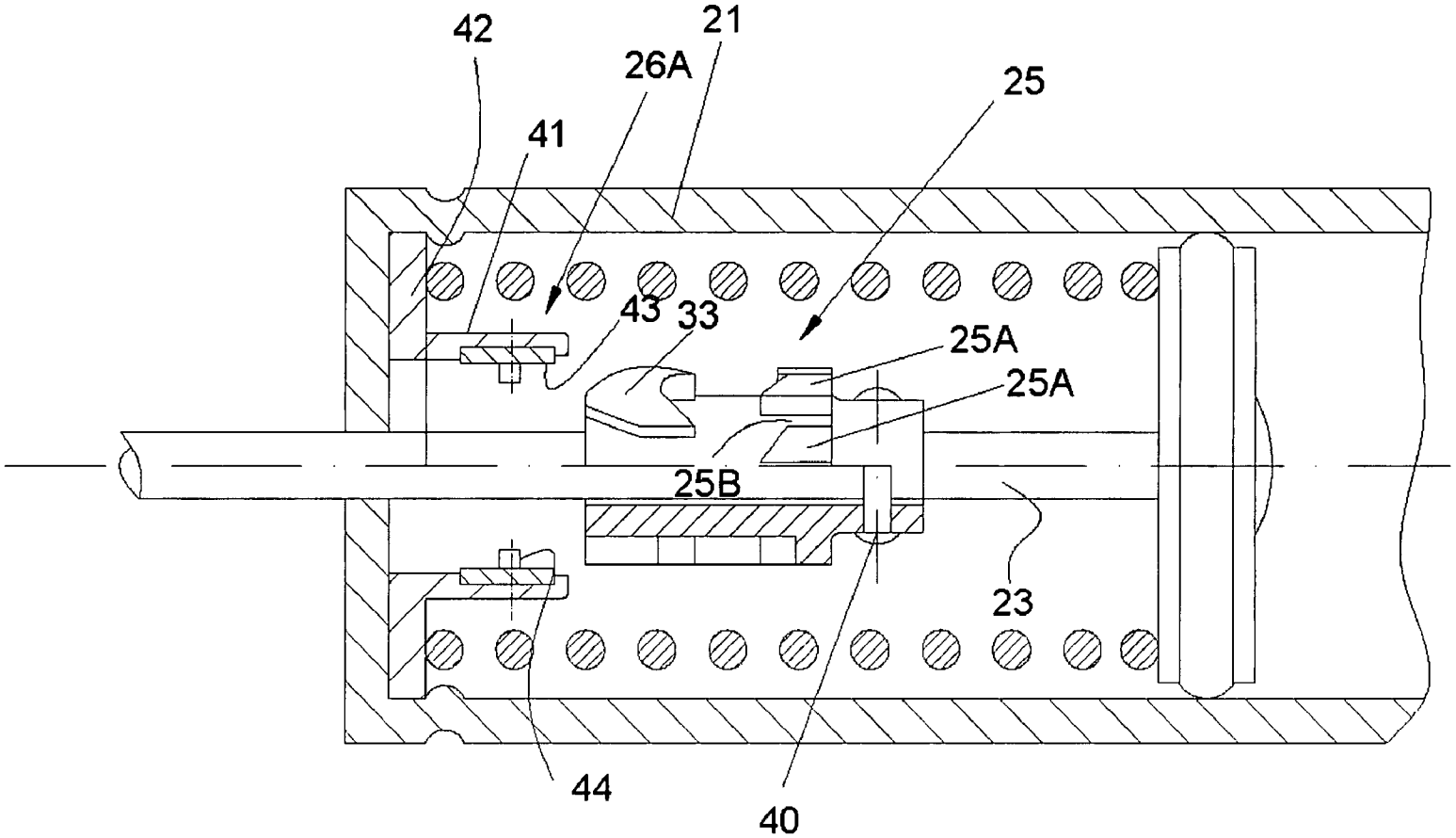
FIG. 9A is a fragmentary sectional side view of a modified embodiment of the type shown in FIG. 9.

FIG. 9A illustrates another modified embodiment which is similar to the described embodiment of FIG. 9 with the exception that the cam component 25 is provided with an interrupted indexing cam profile as described with respect to FIG. 2A. As shown, the indexing cam profile includes a plurality of spaced apart cam segments 25A to define therebetween a channel 25B for accommodating the cam follower 44. In all other respects, the structure and function of the embodiment of FIG. 9A is similar to that hereinbefore described.

Figure 10:
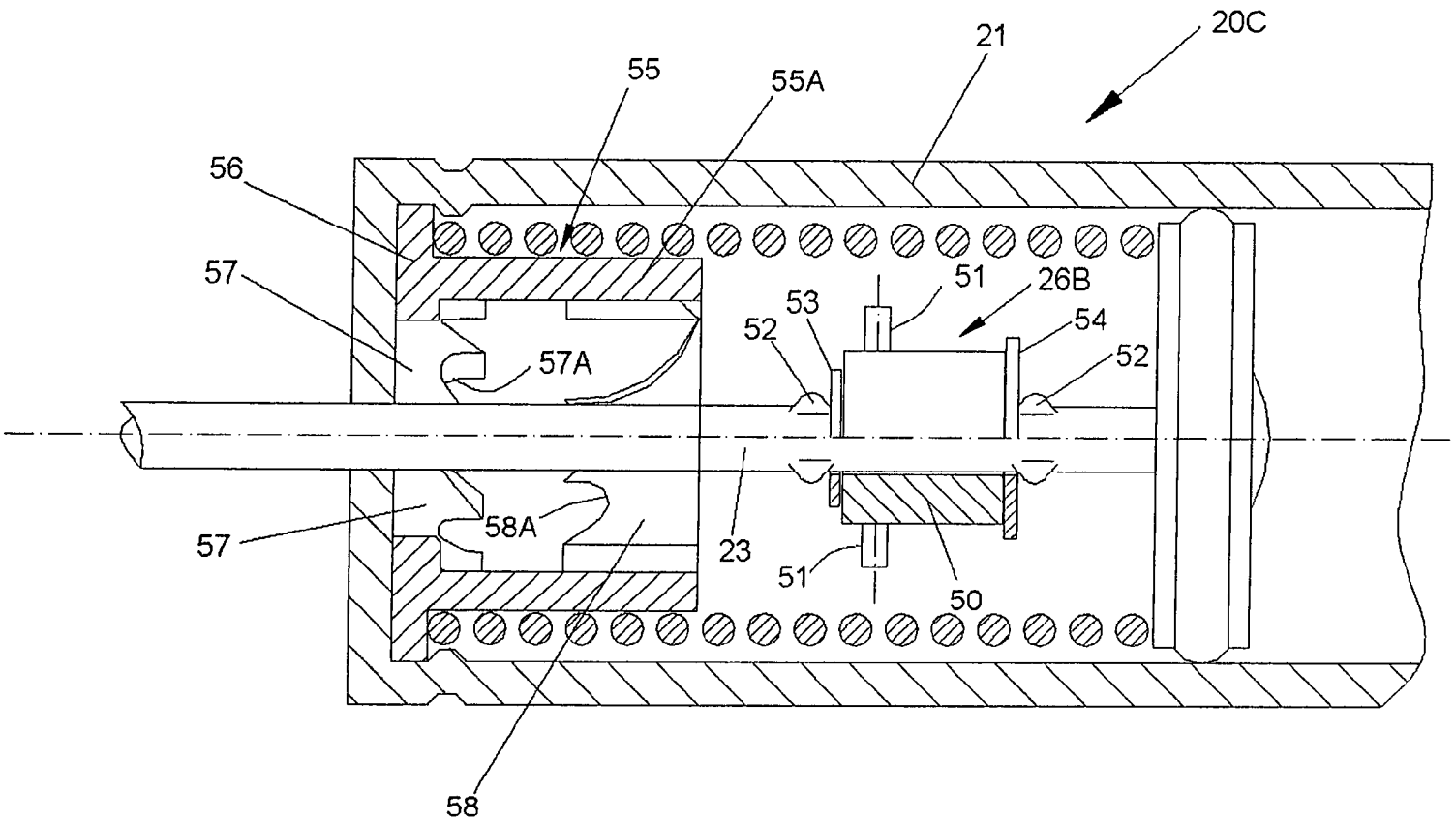
FIG. 10 is a fragmentary side sectional side view of another modified form of the invention.

FIG. 10 illustrates a further embodiment of the invention. In this form of the invention, the door closer 20C includes an arresting mechanism in which the cam follower means 26B is rotatably mounted on the piston rod 23 and the complementary cam means 55 is fixed to the cylinder 21. In this form of the invention, the cam follower means 26B is in the form of a sleeve 50 rotatably mounted on the piston rod 23. Projecting radially outward from, the outer surface of the sleeve 50 are one or more cam followers 51. Two such cam followers 51 oppositely disposed are illustrated. Stop means in the form of a ridge, rim or protuberance or the like 52 located on the piston rod 23 adjacent the opposed ends of the sleeve 50 retains the sleeve 50 in place on the piston rod 23. Suitable washers 53, 54 may be interposed between the stop means 52 and the adjacent end of the sleeve 50.

The cam means 55 includes a cylinder portion 55A and a connected base 56 by which it is fixedly connected to the cylinder 21.

Figure 7:
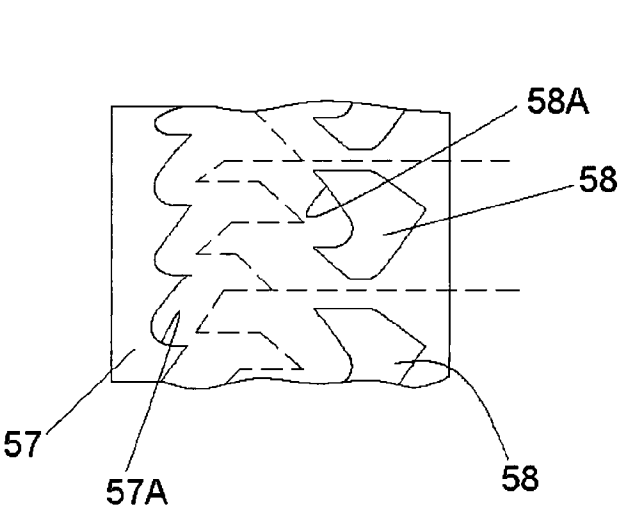
FIG. 7 is an opposite hand view of the cam profile shown in FIG. 6 and as embodied in FIG. 10.
Figure 6A:
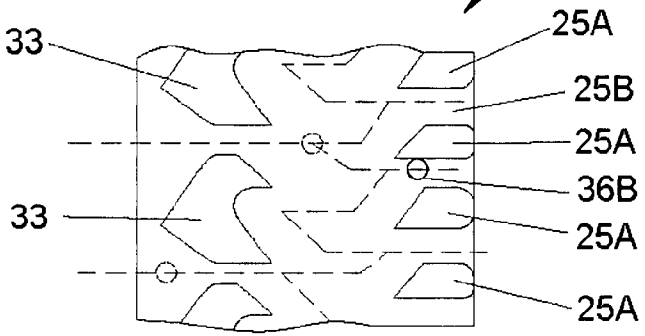
FIG. 6A is an expanded view of the cam profile of FIG. 2A.

Formed on the inner surface of the tubular portion 55A are the annular indexing cam 57 and the plurality of arresting cams 58 which are provided with a profile similar to the indexing cam and arresting cam profiles hereinbefore described. FIG. 7 illustrates the profiles of the indexing cam 57 and arresting cam 58 in an expanded or flattened form. The respective profiles are similar to that hereinbefore described with the exception that the annular indexing cam 57 is formed adjacent the distal or base end of the tubular member 55 and the arresting cams 58 being disposed adjacent the proximate end of the tubular member 55. The respective cam profiles 57A and 58A are similar to that hereinbefore described.

In all other respects, the structure and function of the embodiment of FIG. 10 is similar to that hereinbefore described.

Figure 10A:
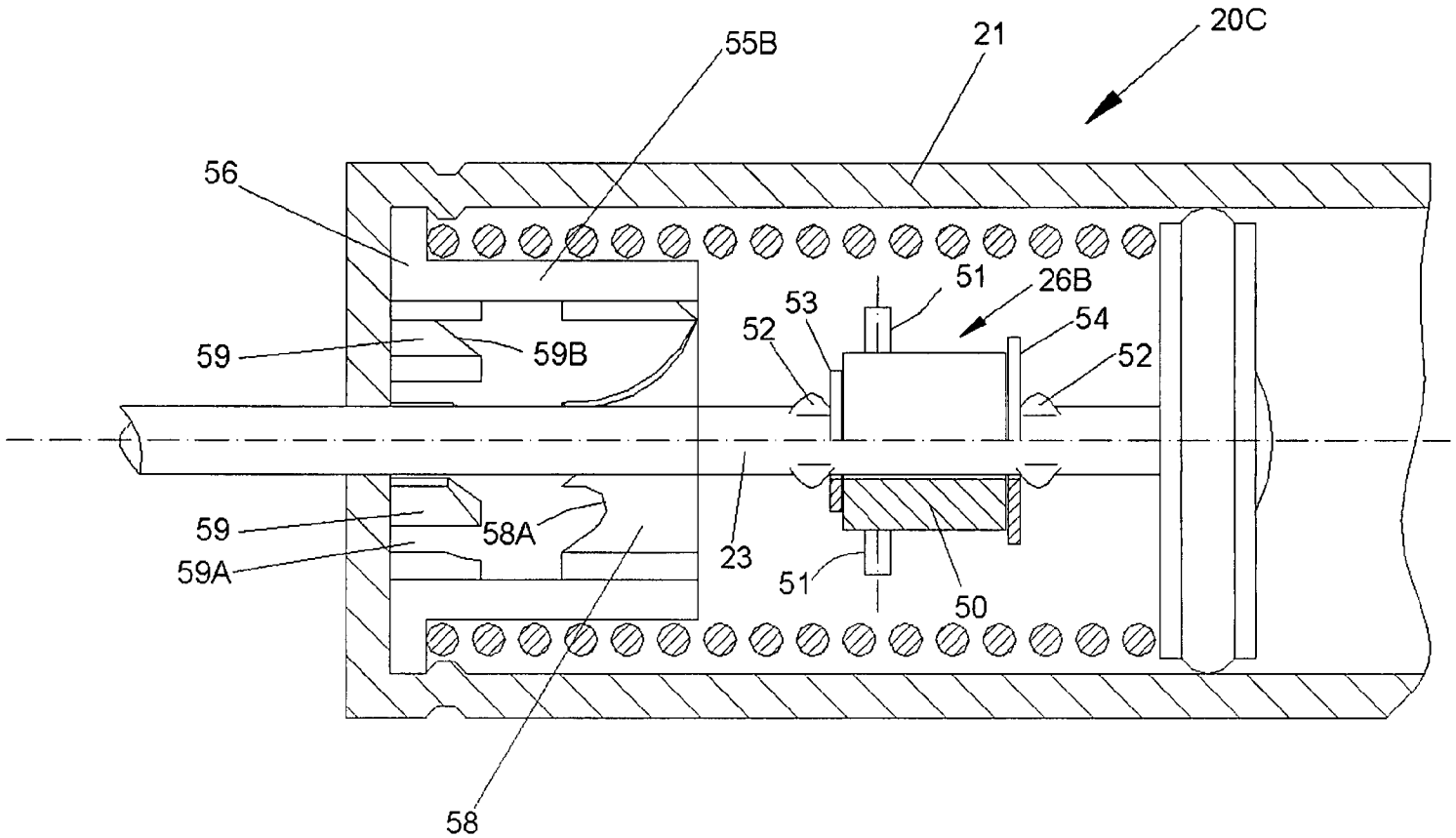
FIG. 10A is a fragmentary sectional view of a modified embodiment of the type shown in FIG. 10.

FIG. 10A illustrates a modified form of the invention as described with respect to FIG. 10. In this form of the invention, the cam component 55B differs in that the indexing cam portion includes a plurality of spaced apart cam segments 59 that are similar to the indexing cam in FIG. 4A. In FIG. 10A, the space 59A defined between the cam segments 59 are adapted to receive the cam followers 51 as the door is moved toward the opening position.

Figure 7A:
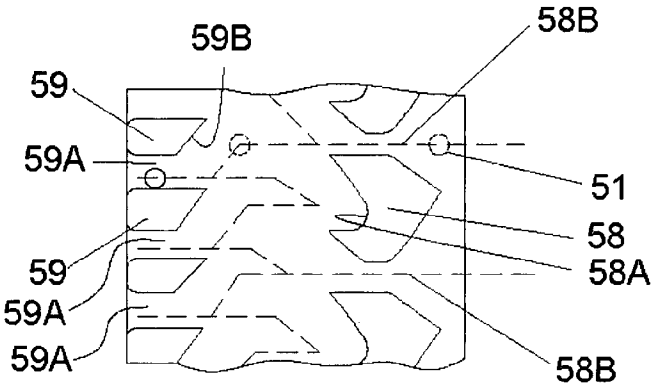
FIG. 7A is an opposite hand view of the cam profile shown in FIG. 6A.

As best seen in FIG. 7A, the camming edge 59B of the alternating cam segments 59 are in alignment with the channel openings 58B with the other alternate spaces 59A between adjacent cam segments 59 being essentially opposite the arresting dwell 58A of the arresting cams 58.

In operation, as the door is moved toward its open position, the rotatable mounted cam follower 51 is guided by the arresting cam 58 into the channel opening 58B, as best seen in FIG. 7A. As the door approaches the opened position, the cam follower 51, on engaging the indexing cam edge 59B, is guided to the adjacent space 59A formed between cam segments 59. Upon release of the door on opening, the compression spring causes the cam follower 51 to engage the arresting dwell 58A of the opposed arresting cam 58 to arrest the door from closing.

To release the door from its arrested open position, the door is moved toward the opening position an amount sufficient to cause the cam follower 51 to engage the edge 59B of the next cam segment causing the cam follower to be rotated or indexed an amount sufficient to place the cam follower 51 in alignment with the next succeeding channel opening 58B, thereby allowing the door to fully close automatically, under the force of the compression spring.

Figure 11:
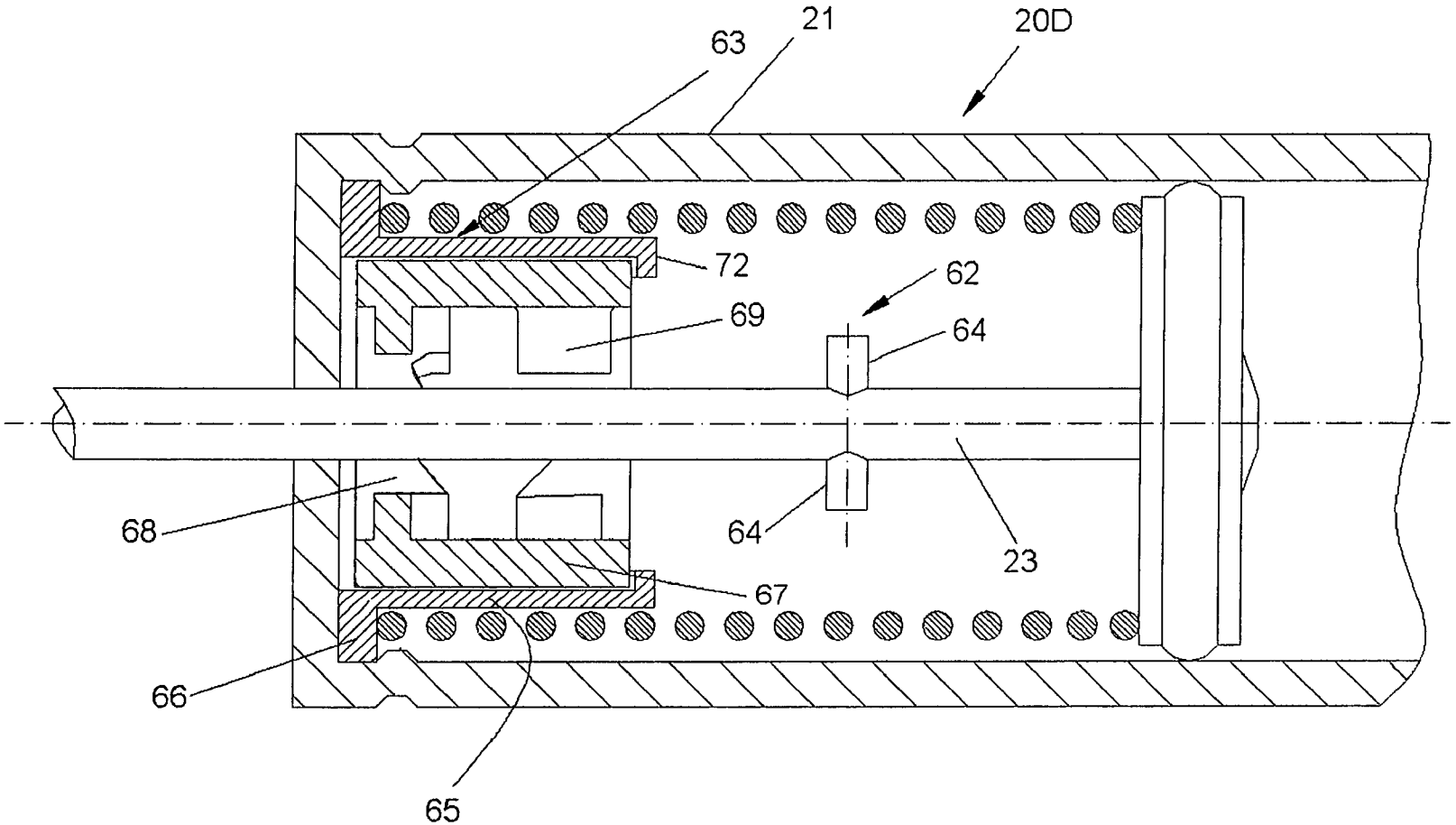
FIG. 11 is a fragmentary side sectional view of another modified form of the invention.
Figure 11A:
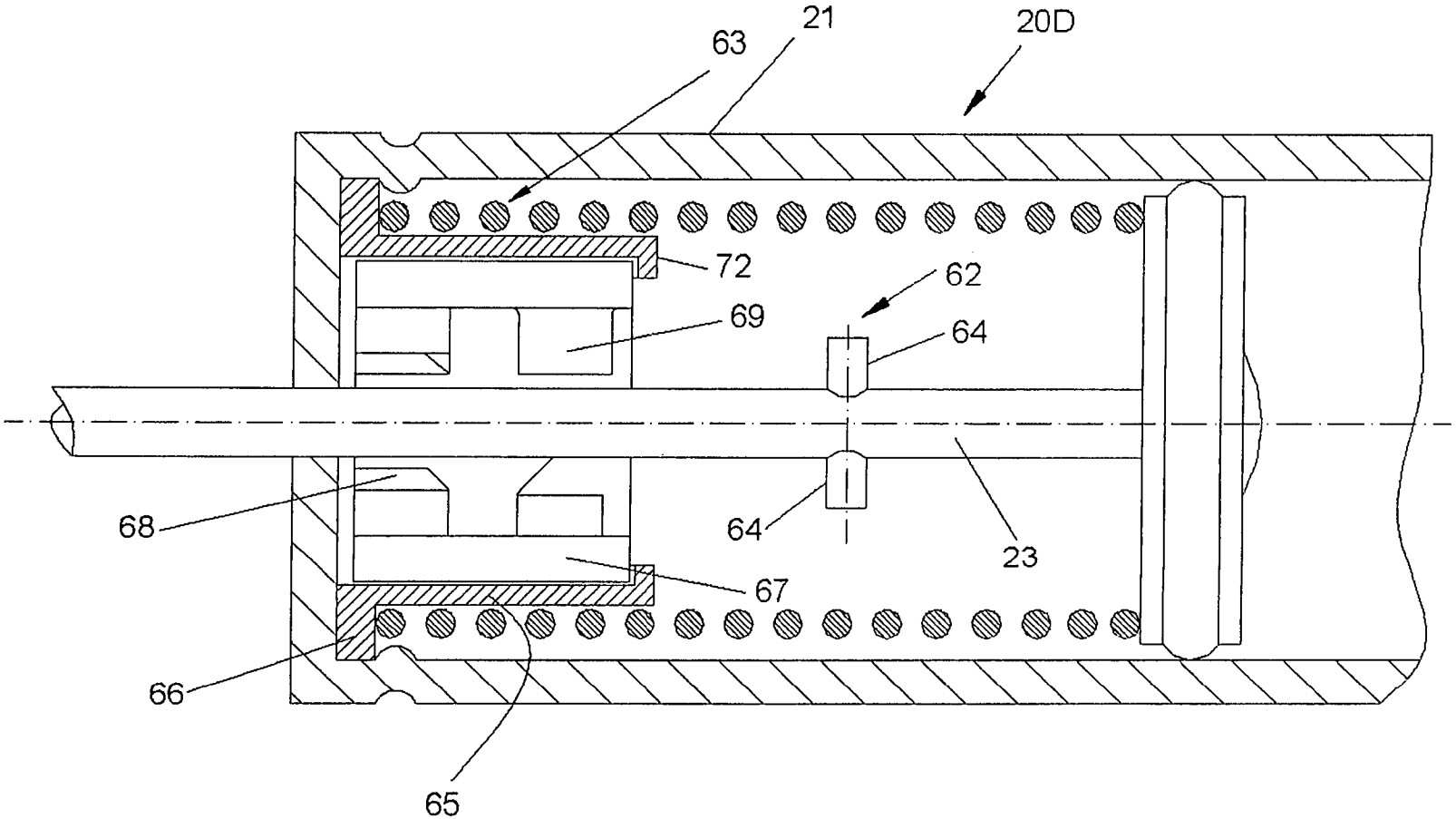
FIG. 11A is a fragmentary sectional side view of a modified embodiment of the type shown in FIG. 11.

FIG. 11 is directed to another embodiment of the invention. In this form of the invention, the door closer 20D is provided with an arresting mechanism in which the cam follower means 62 is fixedly connected to the piston rod 23 and the cam means 63 is rotatably journalled relative to the cylinder 21. In this form of the invention, the cam follower means 62 includes one or more radially outwardly extending follower pins 64 fixedly connected to the piston rod 23. Two such oppositely disposed cam follower pins 64 are illustrated.

The complementary cam means 63 includes a cam housing 65 having a base flange 66 which is suitably connected to the cylinder 21. Rotatably journalled within the cam housing 65 is a cam ring 67. Formed on the inner surface of the cam ring 67 is an annular indexing cam 68 and oppositely disposed, a plurality of arresting cams 69. The annular indexing cam 68 and the arresting cam are formed with a cam profile similar to that hereinbefore described with respect to FIGS. 4 and 10.

Figure 5:
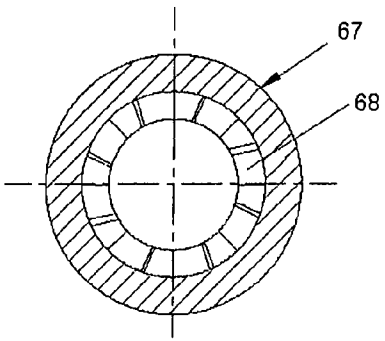
FIG. 5 is a sectional view taken along line 5—5 on FIG. 4.
Figure 4:
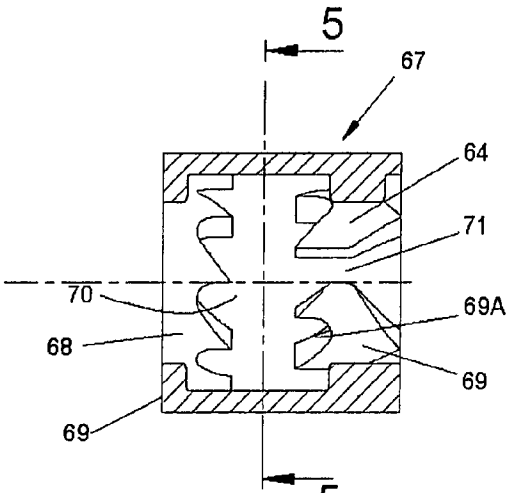
FIG. 4 is a side section view of a modified cam portion of the arresting mechanism of the disclosed invention.
Figure 4A:
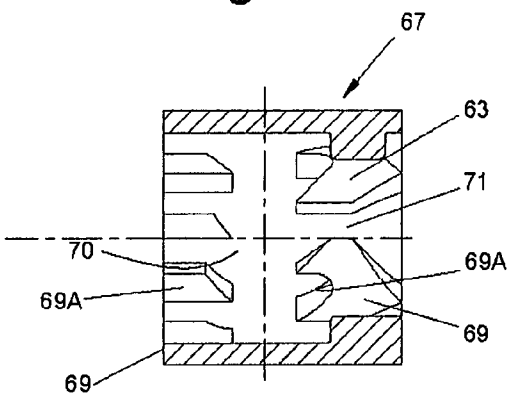
FIG. 4A is a side sectional view of another embodiment of the cam portion of FIG. 4.

As best seen in FIGS. 4 and 5, the cam ring 67 has the annular indexing cam 68 circumscribing the inner surface of the ring 67 adjacent the distal end. The annular indexing cam 68 is provided with a cam profile containing alternating dwells and peaks as hereinbefore described. The respective arresting cams 69 are provided with an arresting dwell 69A similar to that hereinbefore described. An annular cam channel 70 is defined between the respective profiles of the indexing cam 68 and the arresting cams 69 which connect to the channel openings 71 defined between adjacent arresting cams 69. As noted in FIG. 11, the cam ring 67 is rotatably retained within its housing 65 by a retaining means such as an inturned lip or flange 72 or other suitable retainer. In all other respects, the structure and operation of the door closure 20D is similar to that herein described.

As the camming component in certain embodiments of the invention herein has been described as having an annular or endless indexing profile having connected alternating peaks and dwells, the indexing profile need not be annular or endless for all embodiments of the invention. Reference is made to FIGS. 6A, 7A, 8A, 9A, 10A and 11A, which illustrate other embodiments of the invention. In these embodiments, the door closer 20E includes a cylinder 21 and piston 22 with a connected piston rod 23 similar to that hereinbefore described. A compression spring 24 normally biases the piston toward a door closing position. In these embodiments, the cam component differs in that the indexing cam comprises a plurality of spaced apart cam segments to define a space or channel therebetween to accommodate the cam follower, and a plurality of spaced arresting cams, each having a dwell notch 58A (FIG. 7A).

The arrangement is such that the dwell notch of arresting cams are located substantially opposite an inclined cam edge of the alternate indexing cam segments. As hereinbefore described, the arresting cams are longitudinally spaced from the indexing cams to define therebetween an annular channel that communicates with channel opening defined between adjacent pairs of arresting cams. Each arresting cam is provided with a cam profile to direct the cam follower to a channel opening as the associated door is opened and as the spring 24 is compressing. As the door approaches the open position, the cam follower engages the cam profile of the indexing cam, causing a relative rotation to occur between the cam follower and the cam component. Upon release of the door, the compression spring will tend to bias the piston toward the door closing position. In doing so the cam follower is directed to the dwell notch of the arresting cam to arrest any further closing of the door.

To release the door from its arrested position, the door is shifted toward the opening position whereby the cam follower engages the inclined cam surface of the next succeeding indexing cam segment, causing a slight relative rotation between the cam component and the cam follower whereby the cam follower is positioned in alignment with one of the channel openings formed between the arresting cams and thereby permitting the compression spring to bias the piston to a fully door closed position.

It is therefore apparent that the index cam means may be provided with a continuous or annular profile as hereinbefore described, or with an intermittent profile as described with respect to FIGS. 8A, 9A, 10A and 11A.

It will therefore be apparent that the improved self-actuating asserting means in essence includes complementary camming means and follower means, one of which is connected to the piston rod and the other to the cylinder, and wherein one is fixedly connected to either the cylinder or the piston rod and the other rendered rotatable relative to the fixed component.

While the invention has been described with respect to several embodiments thereof, it will be understood that variations and modifications may be made without departing from the spirit or scope of the invention.

What is claimed is:

1. A self activated arresting door closer comprising:

a cylinder, a piston reciprocally displaceable within said cylinder, a piston rod connected to said piston, said piston rod having a free end extending beyond the end of said cylinder, a compression spring normally biasing said piston toward a door closing position, and a self activated arresting mechanism for arresting an associated door in an open position, said arresting mechanism including a cam means and a complementary follower means, one of said means connected to said piston rod and the other of said means connected to said cylinder wherein one of said means is fixedly connected and the other of said means is rendered rotatable relative to said fixed means, said cam means including an indexing cam, a plurality of arresting cams spaced from said indexing cam to define a circumscribing channel therebetween, and said arresting cams defining between adjacent pairs thereof a channel opening in communication with said circumscribing channel.

2. A self activated arresting door closer as defined in claim 1 wherein said indexing cam comprises an annular cam having alternating peaks and dwells.

3. A self activated arresting door closer as defined in claim 1 wherein said indexing cam includes a plurality of spaced apart cam segments to define therebetween a space for receiving said complementary follower means.

4. A self activated arresting door closer as defined in claim 3 wherein each of said arresting cams include a dwell notch, and said space being disposed opposite a channel opening formed between adjacent arresting cams.

5. A self activated arresting door closer as defined in claim 1 wherein:

said indexing cam includes a series of alternating peaks and dwells, and said arresting cams each including a dwell located substantially opposite said alternating peaks of said indexing cam.

6. A self activating arresting door closer as defined in claim 5 wherein said dwell of each said arresting cams being disposed between adjacent pairs of channel openings.

7. A self activating arresting door closer as defined in claim 5 wherein said cam means having alternating peaks and dwells whereby the alternate peaks are disposed opposite said dwells of adjacent arresting cams.

8. A self activated arresting door closer as defined in claim 1 wherein:

said indexing cam includes a series of alternating peaks and dwells, and said channel opening being disposed substantially opposite alternate peaks of said indexing cam.

9. A self activating door closer as defined in claim 1 wherein said cam means includes a sleeve and said indexing cam and arresting cams are formed on the outer surface of said sleeve.

10. A self activating door closer as defined in claim 1 wherein said cam means includes a sleeve and said indexing cam and arresting cams are formed on the inner surface of said sleeve.

11. A self activating door closure as defined in claim 1 wherein said follower means being shaped to be received within said channel opening and said circumscribing channel.

12. A self activated arresting door closer comprising:

a cylinder, a piston reciprocally displaceable within said cylinder, a piston rod connected to said piston, said piston rod having a free end extending beyond the end of said cylinder, a compression spring normally biasing said piston toward a door closing position, and a self activated arresting mechanism for arresting an associated door in an open position, said arresting mechanism including a cam means and a complementary follower means, one of said means connected to said piston rod and the other of said means connected to said cylinder wherein one of said means is fixedly connected and the other of said means is rendered rotatable relative to said fixed means, said cam means is fixedly connected to said piston rod and said follower means is rotatably journaled to said cylinder.

13. A self activated arresting door closer comprising:

a cylinder, a piston reciprocally displaceable within said cylinder, a piston rod connected to said piston, said piston rod having a free end extending beyond the end of said cylinder, a compression spring normally biasing said piston toward a door closing position, and a self activated arresting mechanism for arresting an associated door in an open position, said arresting mechanism including a cam means and a complementary follower means, one of said means connected to said piston rod and the other of said means connected to said cylinder wherein one of said means is fixedly connected and the other of said means is rendered rotatable relative to said fixed means, said cam means is rotatably journaled to said cylinder and said follower means fixedly connected to said piston rod.

14. In a door closer having a cylinder, a piston reciprocally displaceable within said cylinder, a piston rod connected to said piston, said piston rod having a free end extending beyond the end of said cylinder and a compression spring normally biasing said piston toward a door closing position, the improvement of a self activating arresting mechanism for arresting an associated door in a door open position, said self activating arresting mechanism including a cam means and a complementary cam follower means, one of said means being connected to said cylinder and the other of said means being connected to said piston rod whereby one of said means is rotatably journalled relative to said other means, said cam means including an indexing cam and a plurality of arresting cams spaced from said indexing cam to define an annular channel therebetween, a channel opening formed between adjacent pairs of said arresting cams, said channel opening being in communication with said annular channel whereby said cam follower is guided to one said channel opening upon the opening of an associated door, and said indexing cam guiding said cam follower means to engage said arresting cam to prohibit an associated door from closing and to maintain an associated door in the arrested door position until said cam follower means is released from said arresting cam.

15. In a door closer as defined in claim 14 wherein the release of said cam follower means from said arresting cam is effected by shifting the associated door slightly in the direction of the door opening position whereby said cam follower means engages said indexing cam and is guided to said channel opening, permitting the compression spring to advance an associated door to its fully closed position.

16. A door closer comprising:

a cylinder, a piston reciprocally displaceable within said cylinder, a piston rod connected to said piston, said piston rod having a free end extending beyond an end of said cylinder, a compression spring biasing said piston toward a door closing position, and a self activated arresting mechanism for arresting an associated door in an open position, said arresting mechanism including complementary components, one of said components including a cam sleeve, said cam sleeve having formed thereon a plurality of arresting cams, each of said arresting cams having a dwell notch, and a plurality of spaced apart indexing cam segments, each said indexing cam segment having an inclined cam profile, and the other of said components including a cam follower, one of said components being connected to said piston rod and the other of said components being connected to said cylinder, and one of said components being fixedly connected and the other of said components being rendered rotatable relative to said fixed component.

17. A door closer as defined in claim 16 wherein said arresting came and said indexing cams define a channel therebetween, and dwell notches being disposed opposite an alternate inclined cam profile of said indexing cam segments.

18. A door closer as defined in claim 17 wherein said adjacent arresting cams define therebetween a channel opening.

19. A door closer as defined in claim 18 wherein said indexing cams include a cam profile for alternatively directing said cam follower to said dwell notch to arrest a door in the open position and to said channel opening to effect a door closing.

* * * * *